US006550554B2

(12) United States Patent
Gien

(10) Patent No.: US 6,550,554 B2
(45) Date of Patent: Apr. 22, 2003

(54) ROCK DRILL

(76) Inventor: Bernard Lionel Gien, Nos. 2 and 4, Simba Street, Sebenza, Edenvale 1610, Gauteng Province (ZA)

( * ) Notice: Subject to any disclaimer, the term of this patent is extended or adjusted under 35 U.S.C. 154(b) by 0 days.

(21) Appl. No.: 09/730,045

(22) Filed: Dec. 5, 2000

(65) Prior Publication Data

US 2002/0066599 A1 Jun. 6, 2002

(51) Int. Cl.[7] ..... E21B 4/14

(52) U.S. Cl. ..... 175/296; 175/215; 173/78

(58) Field of Search ..... 175/296, 100, 175/306, 405, 417–419, 215; 173/78, 80, 16, 17

(56) References Cited

U.S. PATENT DOCUMENTS 4,819,746 A * 4/1989 Brown et al. ..... 175/296
4,921,052 A * 5/1990 Rear ..... 173/78
5,407,021 A * 4/1995 Kane et al. ..... 175/296
5,685,380 A * 11/1997 Purcell et al. ..... 175/215

* cited by examiner

*Primary Examiner*—Frank S. Tsay
(74) *Attorney, Agent, or Firm*—J. Harold Nissen; Myron Greenspan; Lackenbach Siegel

(57) ABSTRACT

The invention concerns a reverse circulation rock drill having a backhead attached to a piston and cylinder assembly between the backhead and a drill bit assembly and around a sample tube with the outer walls of the sample tube and piston profiled to provide air paths for power and exhaust strokes of the piston, a O-ring seal being provided in the backhead as a check valve.

5 Claims, 5 Drawing Sheets

ROCK DRILL

FIELD OF THE INVENTION

This invention relates to a rock drill and more particularly to a down the hole drill incorporating reverse circulation.

BACKGROUND TO THE INVENTION

Reverse circulation down the hole drills commonly are used to obtain rock and other mineral samples. This method of drilling allows the rock samples to move up through the centre of the drill hammer and then up the centre of the series of dual tube drill rods attached to the hammer, and is preferred to the conventional down-the-hole drilling method where the cuttings are brought to the surface between the drill rod and the wall of the bore hole. Reverse circulation hammers have been in use for a number of years now but are generally expensive and complicated in design and not without their functional problems. Most of these reverse circulation drills have a drill bit, secured to a wear sleeve, with a sample tube running up the centre of the wear sleeve, and a piston forming the hammer which moves about the sample tube. In addition to the above, air passages are generally created by the inclusion of an inner sleeve between the sample tube and the piston, or between the piston and the wear sleeve, or by porting in the wall of the wear sleeve or the piston has openings formed through the wall into the central passage. To accommodate these additions, either the bore of the piston is increased, or the outside diameter of the piston is reduced, both modifications resulting in a lighter piston having less surface area for the compressed air to act on and thus striking the drill bit with reduced force. Ports through the piston wall exacerbate this disadvantage. To increase the weight of the piston it is often lengthened which then results in increased hammer length and consequently increased length of other components of the drill.

OBJECT OF THE INVENTION

It is the object of this invention to provide a reverse circulation drill which at least partially alleviates some of the above mentioned problems.

SUMMARY OF THE INVENTION

According to this invention there is provided a reverse circulation rock drill comprising a backhead, a cylinder extending from the backhead, a piston forming a hammer axially movable within the cylinder, and located to strike a drill but mounted to project from the cylinder at the opposite end to the backhead, a sample tube extending from the drill bit into the backhead, the outer wall of the sample tube profiled partway along its length to form with the interior of the piston an air flow path to lift the piston, the piston having its external wall profiled to form with the cylinder a second air flow path to supply air power to the piston, both air flow paths exhausting beyond the drill bit and operatively out to atmosphere through the sample tube.

Further features of this invention provide for the cylinder to be integral with the drill bit and movable along the backhead, or for the cylinder to be secured to the backhead with the drill bit constrained for limited axial movement within the cylinder.

The invention also provides a check valve in the backhead comprising an O-ring seal located on a surface tapering outwardly from the valve opening.

Still further features provide for passages to be provided through the wall of the sample tube inclined away from the drill bit end and for these passages to be provided adjacent the drill bit end or in the backhead or both.

BRIEF DESCRIPTION OF THE DRAWINGS

Embodiments of this invention will be described below, by way of example only, with reference to the accompanying drawings in which.

DETAILED DESCRIPTION WITH REFERENCE TO THE DRAWINGS

Figure 1:
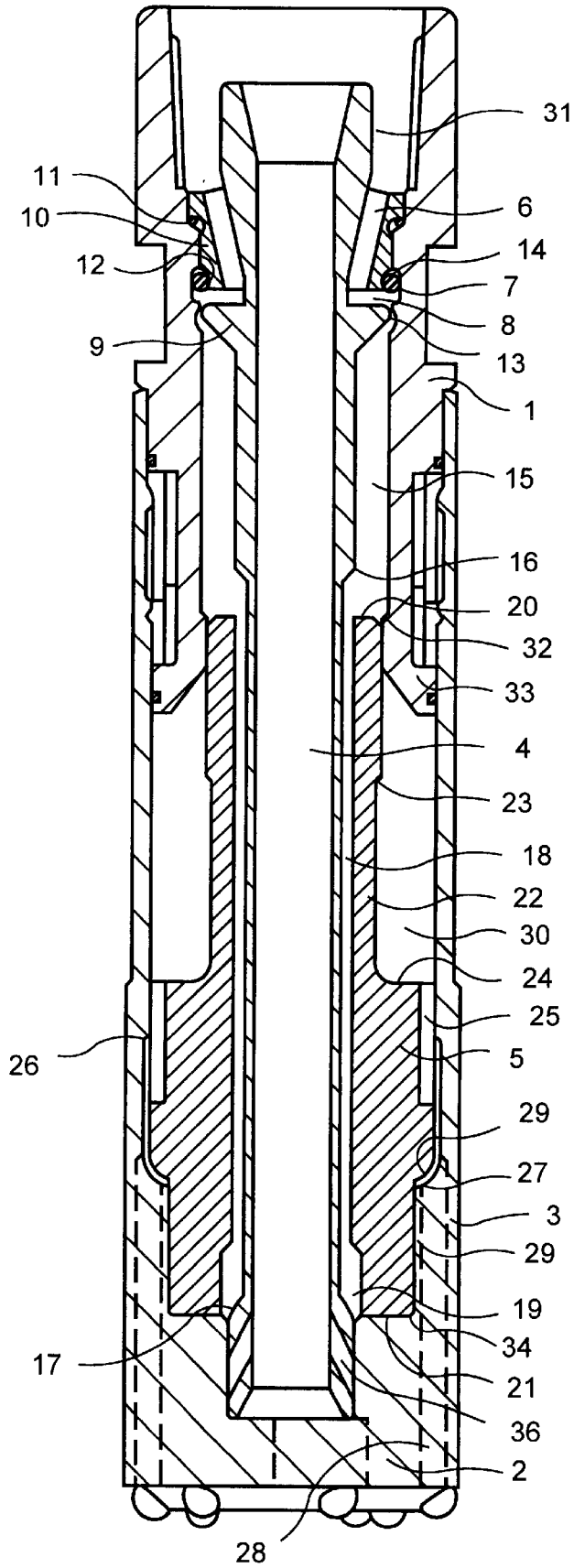
FIG. 1 is a longitudinal section through a first embodiment of a drill head with the piston in the striking position.

Referring to FIG. 1 the rock drill has a backhead (1) and a drill bit (2). Integral with the drill bit (2) is a cylinder (3) which extends over the end of the backhead (1) in sealing engagement with the backhead and having a limited axial movement along the backhead (1).

Figure 2:
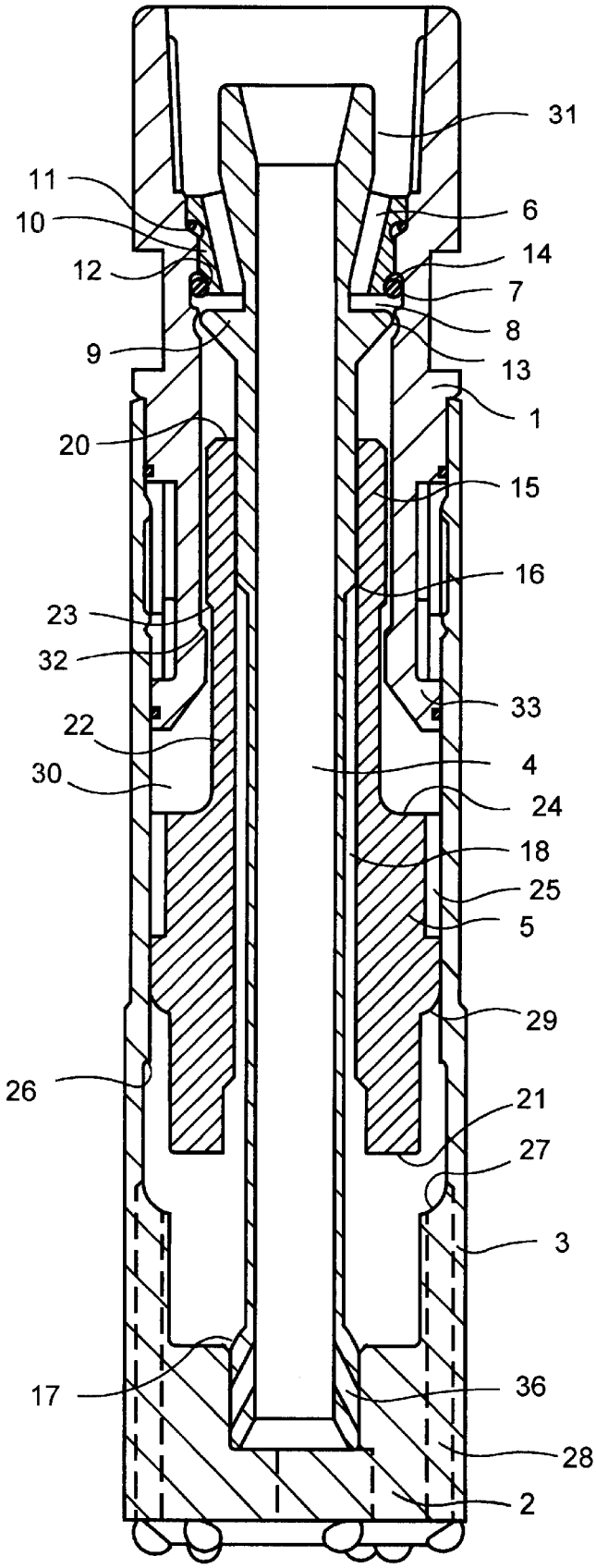
FIG. 2 is a longitudinal section through the drill head of FIG. 1 with the piston in the lifted position.

Extending centrally down the cylinder (3) is a sample tube (4). A piston (5) is slidable around the sample tube (4) and guided by the backhead and cylinder (3) between a striking position (FIG. 1) and a lifted position (FIG. 2). The piston (5) provides the hammer to contact the drill bit (2).

Apertures (6) in the backhead (1) are located to allow air to flow down a drill string into the drill head assembly.

A check valve (7) is provided to control flow into the backhead assembly. The flow from the passages (6) is through an annular opening (8) between the bottom of passages (6) and a collar (9) extending around the sample tube (4). The passages (6) are provided through an insert (10) into the end of the backhead (1) in sealing engagement including a seal indicated at (11). The insert is held in position by the end of the drill string screwed into the backhead (1).

The end of the insert (10) is tapered outwardly at (12) and there is an annular opening (13) between the collar (9) and the inside of the backhead (1). On the tapered part of the insert (10) is positioned a O-ring seal (14) such that in use it seals on the upper surface of the collar (9) and against the taper (12).

Where air under pressure is delivered to the backhead the O-ring rolls up the taper to open a flow path into the backhead through the annular opening (13) around the collar (9).

As external air pressure decreases in relation to the air pressure inside the drill head assembly the O-ring (14) rolls down the insert and seals the opening.

A chamber (15) is formed between the sample tube (4) and the backhead (1) as the sample tube (4) is of smaller diameter than the inside of the backhead (1). The outer surface of the sample tube (4) is radially inwardly stepped along its length to form a shoulder (16) and a further shoulder (17) near the opposite end of the tube (4). This enables a first air passage (18) extending from the shoulder (16) to be formed between the piston (5) and the sample tube (4) which can be closed by appropriate location of the piston (5) on the tube (4). The lower end of the bore of the piston (5) is radially outwardly stepped to create a further air chamber (19). The piston (5) has a top (20) and a base (21)

with a body (22) extending therebetween. The outer surface of the body (22) is radially inwardly stepped to form a shoulder (23) spaced apart from the top surface (20). An outwardly extending circumferential surface (24) is formed on the piston by a further shoulder of larger diameter than shoulder (23) and spaced apart from the shoulder (23). Longitudinally extending slots (25) extend axially partway along the outer surface of the piston (5) from the surface (24) and are symmetrically spaced circumferentially around the piston. The slots (25) in the position of impact of piston (5) partially overlap a series of grooves (26) formed in the wall of the cylinder (2). These grooves (26) extend to an inwardly sloping shoulder (27) in the cylinder. Vents (28) extend longitudinally in the wall of cylinder (3) from the shoulder (27) to open through the bottom of the bit (2). The outer surface of the piston (5) is complimentarily profiled at its lower end (29) to enable it to strike the bit (2). A second air passage (30) is thus defined between the piston (5) and the cylinder (3). The top portion (31) of the sample tube seals with the inner tube (not shown) of a dual tube drill string allowing the cuttings to be exhausted up to the surface.

The bore of the backhead (1) is profiled to form an inwardly projecting shoulder (32) adjacent its lower end (33).

In use, compressed air enters the backhead (1) and flows through the apertures (6) and opening (8) past the check valve (7) and into air chamber (15). The air then moves down the first air passage (18) into the chamber (19) where it acts on the base (21) of the piston (5) and causes the piston (5) to move to a lifted position as shown in FIG. 2. As the piston (5) travels to its lifted position it moves past the shoulder (16) to cut off passage (18) from air chamber (15). The expanding air in chamber (19) pushes the piston (5) further until the base (21) of the piston (5) passes the shoulder (27) in the cylinder (3). This allows air in chamber (19) to exhaust through air vents (28) to the atmosphere via the bore of the sample tube (4), carrying cuttings with it. The piston (5) continues to move under its own inertia until shoulder (23) on the piston (5) passes shoulder (32) in the backhead (1) allowing the compressed air in chamber (6) to flow into chamber (30) formed between the cylinder (3) and piston (5) to act on surface (24) of the piston (5). Air pressure on surface (24) and surface (20) of the piston (5) causes the piston (5) to travel downwards at high speed in the power stroke to strike the anvil (34) of the bit (2). The slots (25) align then with the grooves (26) and air exhausts from passage (8) through the vents (28) to the atmosphere via the sample tube (4) again carrying cuttings with it. Hereafter, the air passage (18) opens again and the cycle begins once more.

Figure 3:
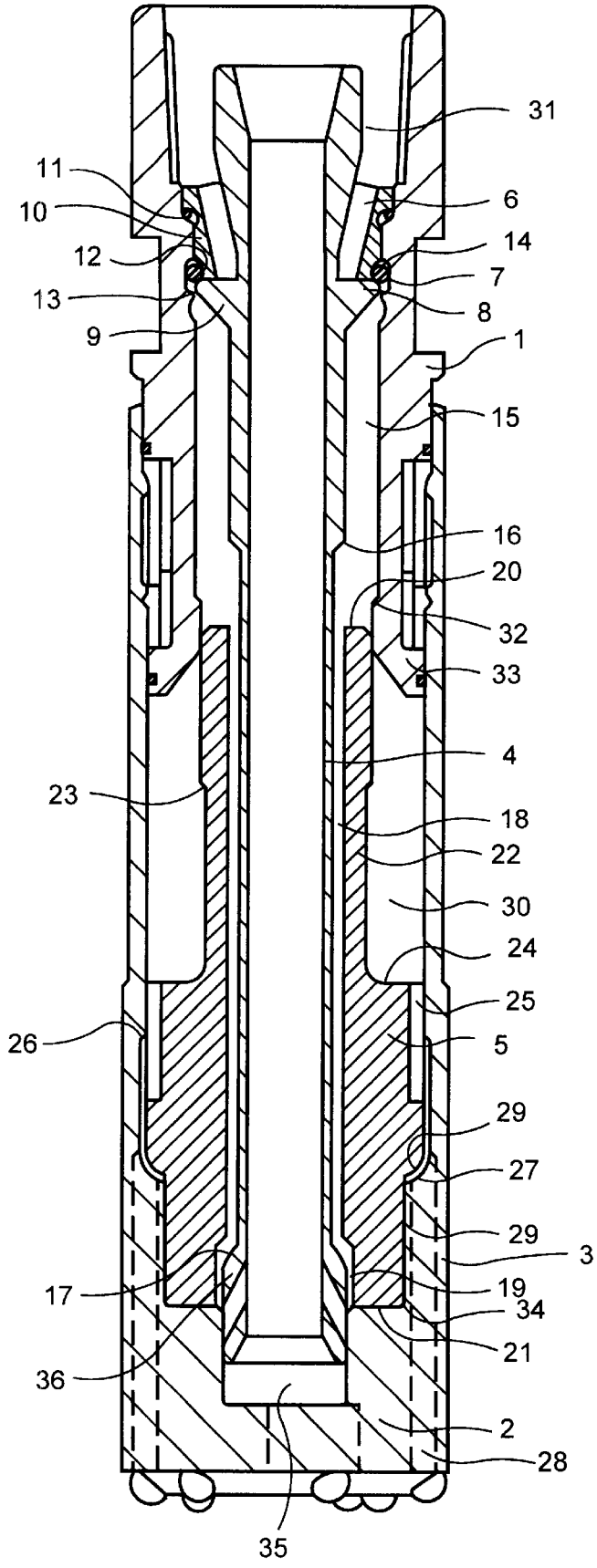
FIG. 3 is a longitudinal section through the drill head of FIG. 1 with the drill head in flushing mode.

Referring to FIG. 3, the drill can be placed in an inactive position or flushing mode by lifting the sample tube (4) in the bore (35) in the drill bit (2). Air moves down air passage (18) to the base of the sample tube (4) where jets (36) are exposed, the air vents through the jets (36) and up the bore of the sample tube (4) creating a venturi action, encouraging cuttings up the sample tube (4) rather than up the outside of the hammer. With this flow path established, the hammer may be brought into the starting mode of FIG. 1. The cuttings continue to flow up the sample tube (4) even after the jets (36) have been shut by the bore of the bit (2) with the drill head assembly operating in the configurations shown in FIGS. 1 and 2.

Figure 4:
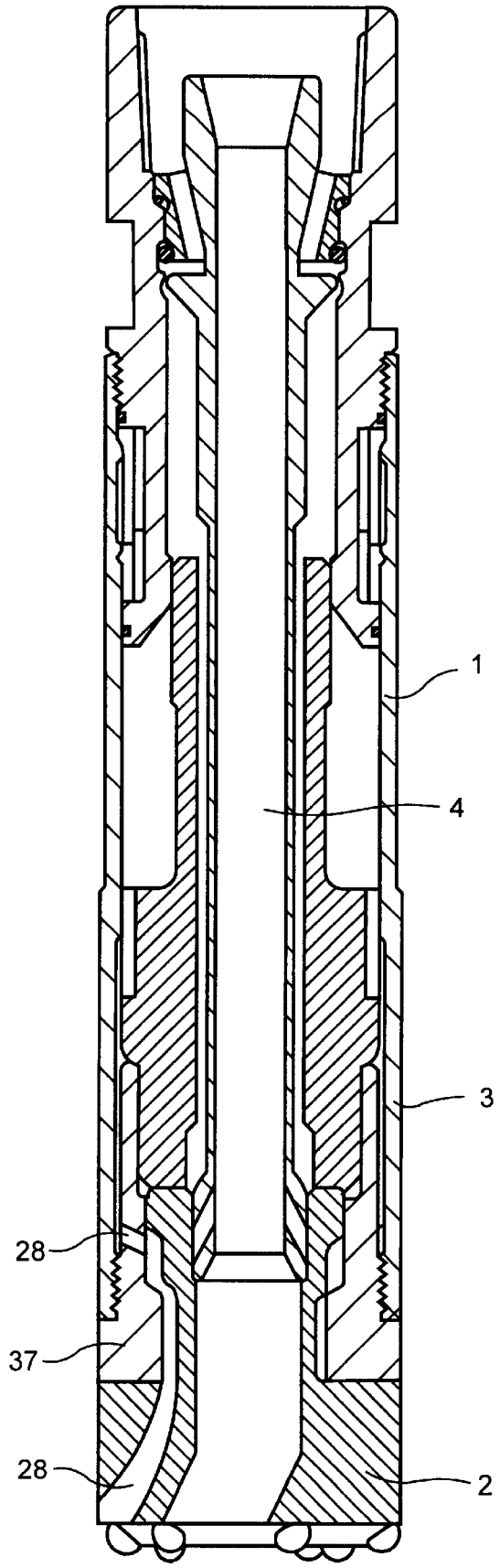
FIGS. 4 and 5 is a longitudinal section through a second and third embodiment of the drill head.

FIG. 4 shows a second embodiment of a drill the drill having a conventional reverse circulation bit. Here the drill bit (2) is a separate entity from the cylinder (3). The cylinder (3) is screwed onto a splined half nut (37) which traps the drill bit (2) in conventional manner allowing limited relative axial movement between the cylinder (3) and the sample tube (4).

The flow passages for air during operation of the drill, as can be seen from the drawings are similar save that in this embodiment the drill bit (2) moves relative to the cylinder (3) which is fixed to the backhead (1).

Figure 5:
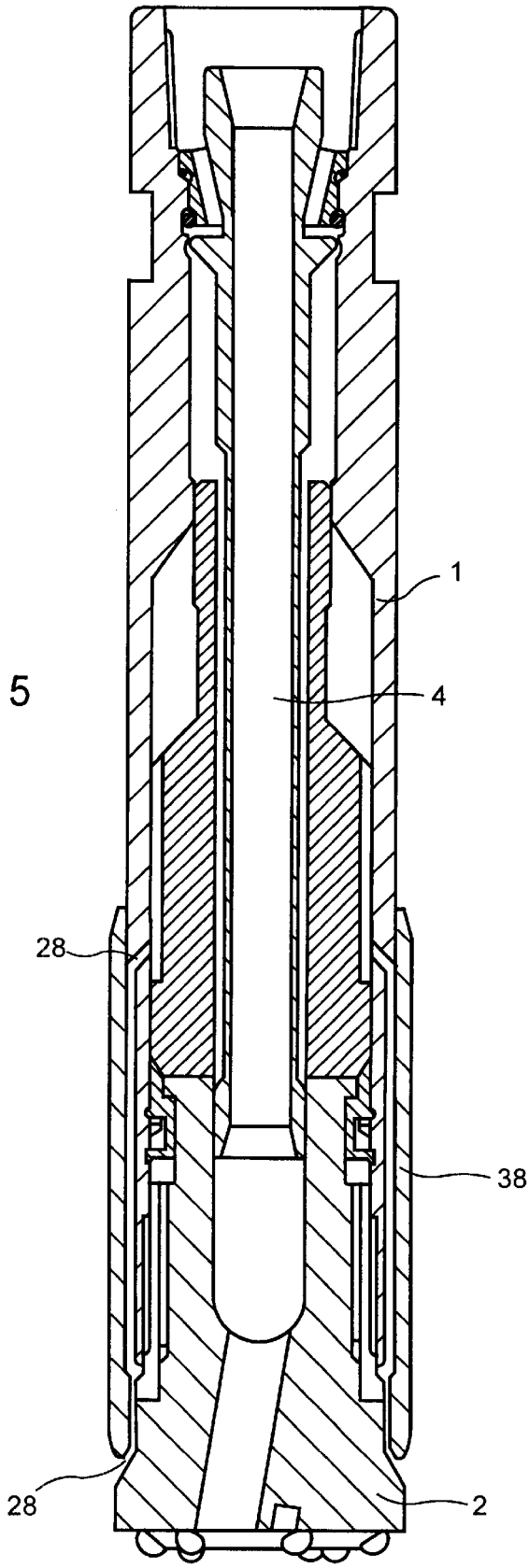

FIG. 5 illustrates a further embodiment of the invention, wherein a replaceable shroud (38) forms part of the cylinder around the drill bit (2) and is secured to the extended end of the backhead (1). This shroud (38) has a number of functions, these being that as the drill bit (2) is worn away, the shroud (38) can be replaced to match the size of the bit (2), further the shroud (38) forms a seal between the drill and the hole being drilled, thus preventing cuttings from going up the outside of the drill instead of up through the bore of the sample tube (4). The shroud (38) provides part of the exhaust air flow path which extends through passages (28) past the bit head (2) and up the bore of the sample tube (4).

It will thus be appreciated that the invention provides a reverse circulation drill which avoids the use of internal wear sleeves and is thus simple in design and yet very effective. The piston has no holes through the wall thereof nor is it thinned down to materially effect its operational weight.

It will further be appreciated that other embodiments of a drill exist which fall within the scope of the invention especially as regards the configuration of the surfaces on the sample tube, piston and housing.

I claim:

1. A reverse circulation rock drill comprising:

a backhead;

a cylinder extending from the backhead;

a piston having an axial bore and an outwardly extending circumferential shoulder providing a driving surface forming a drill hammer movable axially within the cylinder;

a drill bit assembly with its bit mounted to project from the opposite end of the cylinder to the backhead and located to be struck by the piston; and a sample tube extending from the drill bit through the piston into the backhead;

characterized in that;

the outer wall of the sample tube is profiled partway along its length to form with the bore through the piston an air flow path for air to lift the piston;

the external wall of the piston is profiled to form with the cylinder a second air flow path for the supply flow of air to the driving surface on the piston; and both air flow paths extending to open through the drill bit.

2. A reverse circulation rock drill as claimed in claim 1 characterised in that the cylinder is integral with the drill bit assembly and is movable on the backhead.

3. A reverse circulation rock drill as claimed in claim 1 in which the cylinder is secured to the backhead and the bit constrained for limited axial movement within the drill bit assembly.

4. A reverse circulation rock drill as claimed in claim 1 characterised in that a check valve is included in the backhead the valve having an O-ring seal located on a surface tapering outwardly downstream of the valve opening.

5. A reverse circulation rock drill as claimed in claim 1 in which flow passages are provided through the wall of the sample tube and inclined towards the backhead end of the tube.

* * * * *